US006206668B1

(12) United States Patent
Teraoka et al.

(10) Patent No.: US 6,206,668 B1
(45) Date of Patent: Mar. 27, 2001

(54) FLUID MACHINE

(75) Inventors: Masao Teraoka; Kenji Hiraishi, both of Tochigi-ken (JP)

(73) Assignee: Tochigi Fuji Sangyo Kabushiki Kaisha, Tochigi (JP)

( * ) Notice: Subject to any disclaimer, the term of this patent is extended or adjusted under 35 U.S.C. 154(b) by 0 days.

(21) Appl. No.: 09/017,580

(22) Filed: Feb. 3, 1998

(30) Foreign Application Priority Data

Feb. 7, 1997 (JP) ..... 9-025099

(51) Int. Cl.[7] ..... F03C 2/00
(52) U.S. Cl. ..... 418/206.4; 418/206.1
(58) Field of Search ..... 418/206.4, 206.1

(56) References Cited

U.S. PATENT DOCUMENTS

| | | | | |
|---|---|---|---|---|
| 2,853,766 | | 9/1958 | Wellington et al. . | |
| 2,857,779 | | 10/1958 | Frei et al. . | |
| 3,799,713 | * | 3/1974 | Cloots et al. | 418/206 |
| 4,390,331 | | 6/1983 | Nachtrieb | 418/141 |
| 4,511,316 | * | 4/1985 | Ellis | 418/150 |
| 4,938,670 | * | 7/1990 | Lee | 418/150 |
| 4,974,318 | | 12/1990 | Heppekausen et al. . | |
| 5,468,132 | * | 11/1995 | Snell et al. | 418/206 |

FOREIGN PATENT DOCUMENTS

| | | | | |
|---|---|---|---|---|
| 693372 | | 7/1940 | (DE) . | |
| 882746 | | 7/1953 | (DE) . | |
| 2409554 | | 9/1975 | (DE) . | |
| 3407-479 | * | 10/1984 | (DE) | 418/150 |
| 0637691 | | 2/1995 | (EP) . | |
| 556701 | | 10/1943 | (GB) . | |
| 2 033 475 | | 5/1980 | (GB) | 74/64 |
| 2033475 | * | 5/1980 | (GB) | 418/150 |
| 2 141 486 | | 12/1984 | (GB) | 307/3 |
| 2141486 | | 12/1984 | (GB) . | |
| 1525325 | * | 11/1989 | (SU) | 418/150 |
| WO 93/14314 | | 7/1993 | (WO) . | |

* cited by examiner

*Primary Examiner*—Thomas Denion
*Assistant Examiner*—Theresa Trieu
(74) *Attorney, Agent, or Firm*—Morrison & Foerster

(57) ABSTRACT

A fluid machine comprises a rotor (7, 9) meshed with each other in concave and convex portions (23, 26) and (25, 24), and a casing (3) enveloping these elements within cylindrical portions (43, 45) of a rotor chamber (5) and having a flow inlet port (31) and a flow outlet port (33). The cylindrical portions (43, 45) are moved to moved centers (47, 49) from standard centers (35, 37) at a predetermined distance L toward the flow inlet port (31), so that the rotor chambers (5) is expanded to cylindrical portions (55, 57) from the cylindrical portions (43, 45).

6 Claims, 6 Drawing Sheets

FLUID MACHINE

BACKGROUND OF THE INVENTION

1. Field of the Invention

The present invention relates to a fluid machine, for example, used for a supercharger of an automotive vehicle.

2. Description of the Related Arts

A Roots displacement compressor 201 as shown in FIGS. 1 and 2 is described in Japanese Patent Unexamined Application Laid Open No. 2-91492.

The compressor 201 is provided with a compressor casing 203, a pair of rotors 205 and 207, an input pulley 209 and a timing gear set 211.

Each of the rotors 205 and 207 is disposed within a rotor chamber 213 provided in the casing 203 and is rotated by a driving force of an engine input through the input pulley 209. The timing gear set 211 rotates each of the rotors 205 and 207 to an opposite direction to each in a synchronous manner in order that each of the rotors 205 and 207 is not brought into contact with each other.

As shown in FIG. 2, a suction port 215 and a discharge port 217 for a fluid is provided at a position substantially perpendicular to an axial direction of each of the rotors 205 and 207 in the casing 203.

The rotor chamber 213 is structured such that a horizontal cross section (a cross section in a direction perpendicular to the axis) is formed as a letter 8 shape by holes 219 and 221 corresponding to a rotating track of a front end of each of the rotors 205 and 207, and convex portions 223 and 225 projecting to each of the rotors 205 and 207 are formed in a crossing portion of each of the holes 219 and 221 along the axial direction of each of the rotors 205 and 207.

However, as shown in FIG. 3, in the casing 203, the discharge port 217 end becomes a high temperature and is expanded, the suction port 215 end having a lower temperature than the discharge port end is compressed, and a heat moves to the low temperature end from the high temperature end as an arrow 227. Due to an expansion, a compression and a heat movement generated in the above manner, the suction port 215 is displaced to an inner side as described by a broken line 229 and the discharge port 217 is displaced to an outer side, so that a distortion is generated in the casing 203.

Further, since a suction air in the suction port 215 end has a pressure lower than that in the discharge port 217 end, each of the rotors 205 and 207 is displaced to the suction port 215 end by this pressure difference. The displacement is generated in such a manner that each of the rotors 205 and 207 swings around a bearing 231 or a bearing 233.

Due to the distortion of the casing 203 and the displacement of each of the rotors 205 and 207, the casing 203 and each of the rotors 205 and 207 are interfered with each other, so that an abrasion, a seizure, a poor motion of the compressor 201 and the like are generated.

Still further, since the convex portions 223 and 225 are formed in the casing 203, there is a risk that the abrasion, the seizure, the poor motion and the like when the casing 203 and each of the rotors 205 and 207 are interfered with each other are promoted.

Furthermore, in the Roots displacement compressor 201, there is a problem that a discharge of a fluid is intermittently performed and a back flow is generated in the discharge end so that a noise is increased.

SUMMARY OF THE INVENTION

The present invention has been achieved with such points in view.

It therefore is an object of the present invention to provide a fluid machine which prevents an interference between a casing and each of rotors or an abrasion, a seizure and the like when the casing and each of rotors are interfered with each other, thereby preventing the poor motion on the fluid machine.

To achieve the object, according to a first aspect of the present invention, there is provided a fluid machine comprising: a pair of rotors formed with a concave portion and a convex portion in such a manner as to extend to an axial direction, the pair of rotors meshed with each other at the concave portion and the convex portion; and a casing having a rotor chamber formed with a first pair of cylindrical portions enveloping each of the rotors, the casing having a flow inlet port and a flow outlet port for a fluid formed in the casing at a position substantially perpendicular to the axial direction of each of the rotors, the flow inlet port and the flow outlet port disposed inside two lines Y1 and Y2 which are perpendicular to a line X connecting centers of both of the cylindrical portions and pass through the center of each of the cylindrical portions, wherein the rotor chamber is formed with a second pair of cylindrical portions including a horizontal cross sectional shape which is constituted by a part of a circle corresponding to a second rotation track of each of the rotors, together with the first pair of cylindrical portions including a horizontal cross sectional shape which is constituted by a part of a circle corresponding to a first rotation track of each of the rotors; and the second pair of cylindrical portions are moved toward a lower pressure end among the flow inlet port and the flow outlet port from a position of the first pair of cylindrical portions at a predetermined distance L, thereby the volume of the rotor chamber is expanded.

As mentioned above, the second pair of cylindrical portions to envelop each of the rotors is moved or shifted from the position of the first pair of cylindrical portions at the predetermined distance L toward the lower pressure end among the flow inlet port and the flow outlet port. Accordingly, the rotor chamber is expanded at a degree corresponding to a volume increase due to the movement or the shifting of the second pair of cylindrical portions.

Accordingly, the interference between the casing and each of the rotors is prevented, and the abrasion and the seizure of these elements, the poor motion of the fluid machine and the like can be prevented.

According to a second aspect of the present invention, there is provided a fluid machine, comprising: a pair of rotors meshed with each other at a concave and convex portion formed in such a manner as to extend to an axial direction; and a casing enveloping each of the rotors in a pair of cylindrical portions provided in a rotor chamber in such a manner as to rotate and having a flow inlet port and a flow outlet port for a fluid, the flow inlet port and the flow outlet port are provided at a position substantially perpendicular to the axial direction of each of the rotors, wherein a horizontal cross sectional shape of each of the cylindrical portions is constituted by a part of a circle corresponding to a rotation track of each of the rotors; the flow inlet port and the flow outlet port are disposed inside two lines Y1 and Y2 which are perpendicular to a line X connecting centers of both of the cylindrical portions and pass through the center of each of the cylindrical portions; and positions of the cylindrical portions are moved to a moved center position from a standard center position at a predetermined distance L toward a lower pressure end among the flow inlet port and the flow outlet port, so as to expand the rotor chamber to a volume including each of the cylindrical portions at the moved center position together with each of the cylindrical portions at the standard center position.

As mentioned above, the cylindrical portion enveloping each of the rotors is moved to the moved center position from the standard center position at the predetermined distance L toward the lower pressure end among the flow inlet port and the flow outlet port. Accordingly, the rotor chamber is expanded at a degree corresponding to a volume increase due to the movement of each of the cylinder portions to the moved center position.

The higher pressure end among the flow inlet port and the flow outlet port becomes in a high temperature and the lower pressure end becomes in a low temperature, and an expansion and a compression is generated in the casing due to these temperature difference, so that, for example, even when the flow inlet port is displaced to the inner side and further even when each of the rotors is displaced to the flow inlet port end due to the pressure difference between the flow inlet port and the flow outlet port, the distortion of the casing and the displacement of each of the rotors mentioned above are absorbed by making each of the cylinder portions move to the moved center position toward the lower pressure end and expanding the rotor chamber.

Accordingly, the interference between the casing and each of the rotors is prevented, and the abrasion and the seizure of these elements, the poor motion of the fluid machine and the like can be prevented.

According to a third aspect of the present invention, as it depends from the first or the second aspect, when components in respective directions of a line X, a line Y1 and a line Y2 in the predetermined distance L are set to be respectively x1, y1 and y2, a relation 0.05 (mm)≦x, y1, y2≦0.3 (mm) is made.

The structure discloses an optimum range of the distance L (x, y1, y2) at which the center of each of the cylindrical portion is moved, and the cylindrical portion is moved at the optimum moving distance L selected within the range. Accordingly, the interference between the casing and each of the rotors can be prevented in the manner mentioned above without affecting the performance of the fluid machine.

According to a fourth aspect of the present invention, as it depends from the first, the second or the third aspect, each of the rotors is rotated by a prime mover, the fluid is sucked from the flow inlet port of the casing and is discharged from the flow outlet port, and the center of each of the cylindrical portion is moved to the flow inlet port end at the predetermined distance L.

The fourth aspect corresponds to a structure in which the fluid machine is set to be a compressor, and the center of each of the cylindrical portion is moved to the flow inlet port end of the lower pressure end (the lower temperature end) at the predetermined distance L. Accordingly, the interference between the casing and each of the rotors can be prevented in the manner mentioned above.

According to a fifth aspect of the present invention, as it depends from one aspect among the first aspect to the fourth aspect, each of the cylindrical portions are crossed to each other so as to form a round portion having a predetermined radius r on one or both of a convex portion formed in the flow inlet port end and the flow outlet port end.

As mentioned above, the round portion having a predetermined radius r is given to the one or the both of the convex portion formed in such a manner as to project to the rotor end by each of the cylindrical portions crossing to each other in the flow inlet port end and the flow outlet port end.

As in the same manner as that of the first and the second aspect, even when the casing and each of the rotors are interfered with each other by the expansion and compression of the casing due to the temperature difference between the flow inlet port end and the flow outlet port end and by the displacement of each of the rotors due to the pressure difference in the flow inlet port end and the flow outlet port end, the abrasion and the seizure of each of the rotors and the casing can be prevented and the poor motion in the fluid machine can be prevented by the round portion given in the convex portion of the casing.

Further, as mentioned above, even when the casing and each of the rotors are interfered with each other due to the temperature difference and the pressure difference between the flow inlet port end and the flow outlet port end, the abrasion and the seizure of each of the rotors and the casing can be prevented and the poor motion in the fluid machine can be prevented by the round portion given in the one or the both of the convex portions formed in the flow inlet port end and the flow outlet port end of the casing.

According to a sixth aspect of the present invention, as it depends from one aspect among the first aspect to the fifth aspect, when a radius of a circle corresponding to a rotating track of each of the rotors is set to be R, a relation $\frac{1}{10}$R (mm)≦r≦$\frac{1}{5}$R (mm) is made.

The structure discloses an optimum range of the radius r of the round portion given to the convex portion of the casing, and when the radius of the circle corresponding to the rotating track of each of the rotors is set to be R, the value of r is set to be within the above range with respect to the value of R. Accordingly, the abrasion, the seizure, the poor motion and the like occurred when the casing and each of the rotors are interfered with each other can be prevented without affecting the performance of the fluid machine.

According to a seventh aspect of the present invention, as it depends from one aspect among the first aspect to the sixth aspect, the predetermined radius r is set to be a different value along an axial direction of each of the rotors.

Since the radius r of the convex portion is changed in the axial direction of each of the rotors in accordance with the deformation amount of the casing different along the axial direction of each of the rotors and the displacement amount of each of the rotors and the optimum radius r is given at each of the portions, the abrasion and the seizure between the convex portion and each of the rotors and the poor motion of the fluid machine can be prevented all around the area in the most effective manner.

In other wards, since the deformation amount of the casing is different along the axial direction of each of the rotors, the abrasion and the seizure with respect to each of the rotors can be prevented all around the area of the convex portion in the most effective manner by giving the optimum radius r to each portion of the convex portion along the axial direction of the rotor, so that the poor motion of the fluid machine can be prevented.

Further, the displacement of each of the rotors due to the pressure difference between the flow inlet port and the flow outlet port is produced in such a manner that each of the rotors swings around the bearing in the above manner. The structure changing the value of the radius r along the axial direction of each of the rotors corresponds to the displacement amount of each of the rotors different in the axial direction, so that the abrasion and the seizure between the casing and each of the rotors, and the poor motion of the fluid machine can be effectively prevented.

According to a eighth aspect of the present invention, as it depends from one aspect among the first aspect to the seventh aspect, each of the rotors is rotated by a prime mover; a fluid is sucked from the flow inlet port of the casing and is discharged from the flow outlet port; and a round portion having a predetermined radius r is given to one or both of the convex portions in the flow inlet port and the flow outlet port.

In addition to the above matter, the eighth aspect corresponds to a structure in which the fluid machine is set to be a compressor, and the round portion having a predetermined radius r is given to the convex portion of the casing in one or both of the flow inlet port (the suction port) and the flow outlet port (the discharge port). Accordingly, the abrasion, the seizure and the poor motion in the fluid machine due to the interference between the casing and each of the rotors as mentioned above can be prevented.

Further, when the round portion is given to the convex portion near the discharge port, a gap is formed between the casing and each of the rotors due to the round portion. The flow speed change for the fluid can be reduced so that the sound is widely reduced. The structure is particularly advantageous for the fluid machine, namely the compressor according to this aspect with the lower sound level in the discharge end even though the sound level in the discharge end of the conventional compressors is high.

Further, when the round portion is given to the convex portion close to the suction port, the gap is formed between the casing and each of the rotors by this round portion, so that the interference between the casing and each of the rotors can be prevented by this gap. Accordingly, the interference between the casing and each of the rotors, the abrasion therebetween, the seizure, the poor motion in the fluid machine and the like can be prevented.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
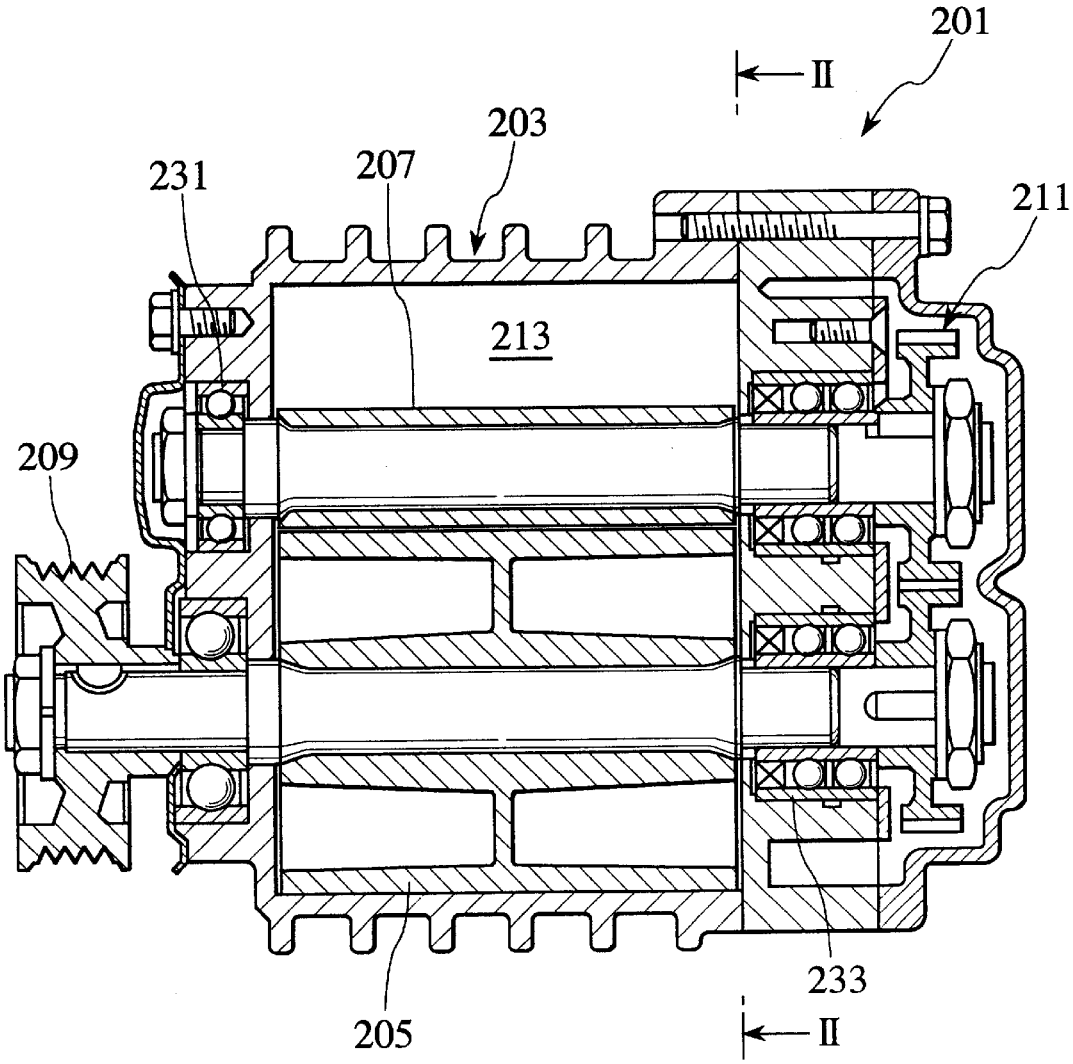
FIG. 1 PRIOR ART
FIG. 1 is a cross section of a front view in accordance with a conventional embodiment.
Figure 2:
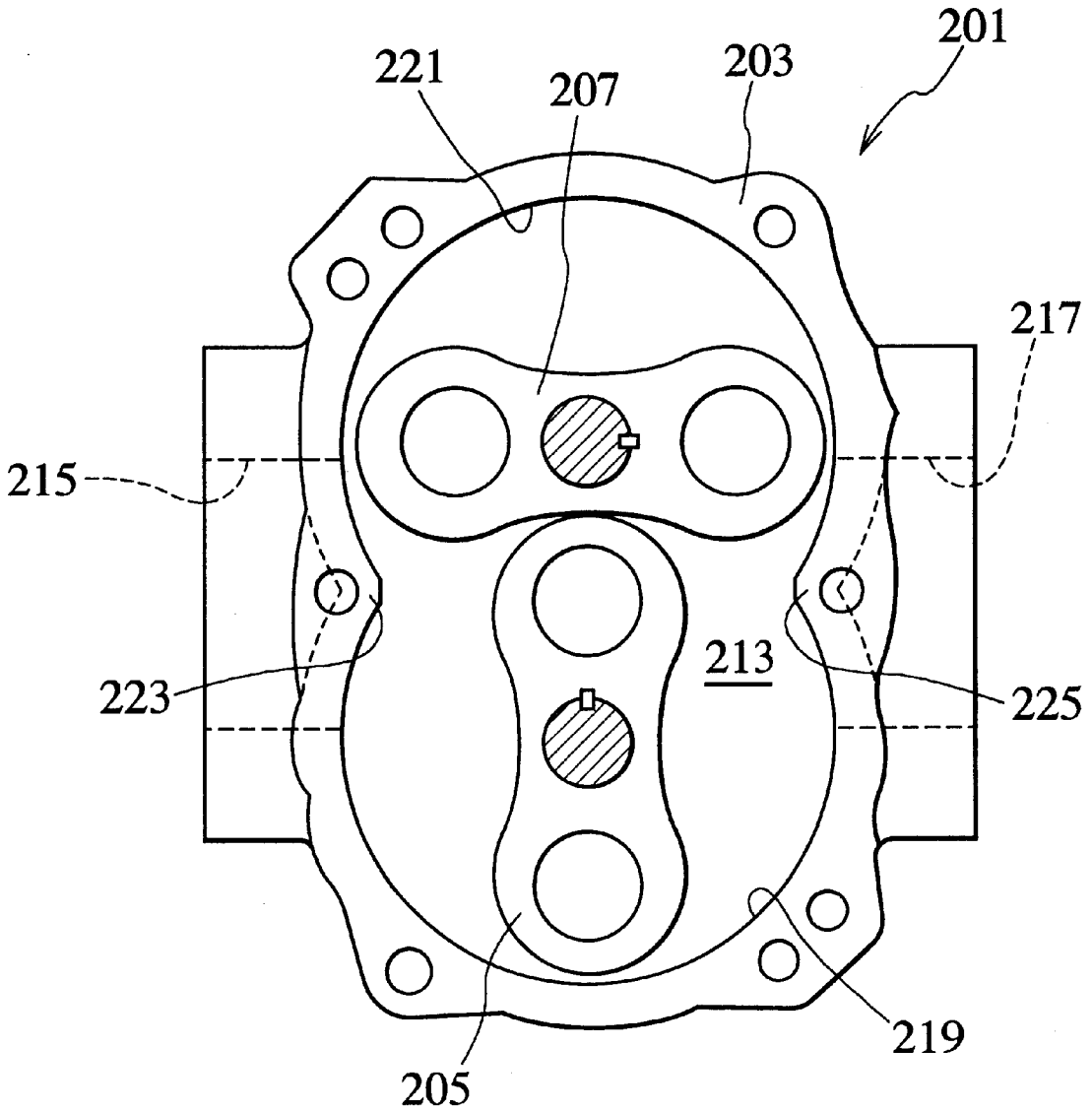
FIG. 2 PRIOR ART
FIG. 2 is a cross sectional view taken along the lines II—II in FIG. 1.
Figure 3:
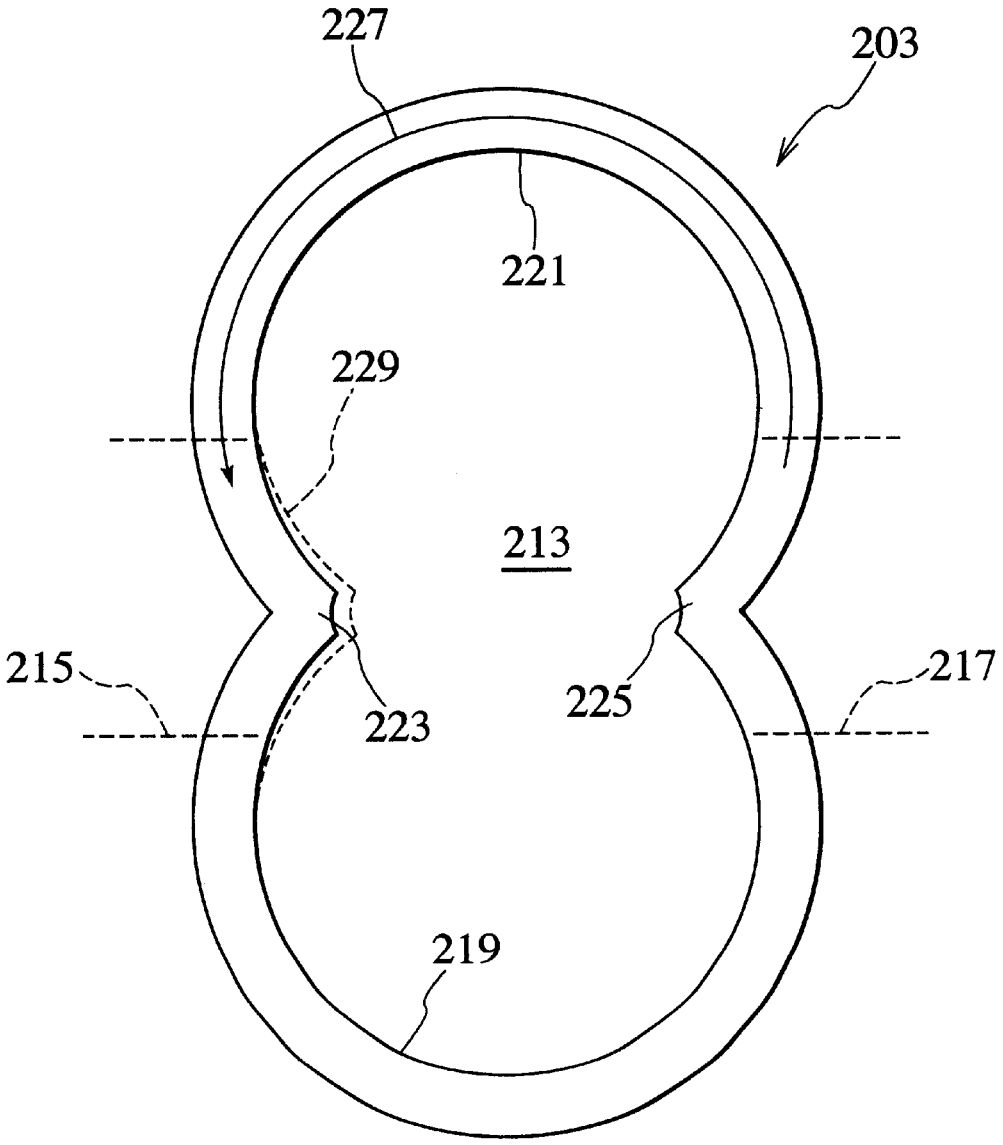
FIG. 3 PRIOR ART
FIG. 3 is a cross sectional view of the casing shown in FIG. 1, showing a distortion state in the casing.
Figure 4:
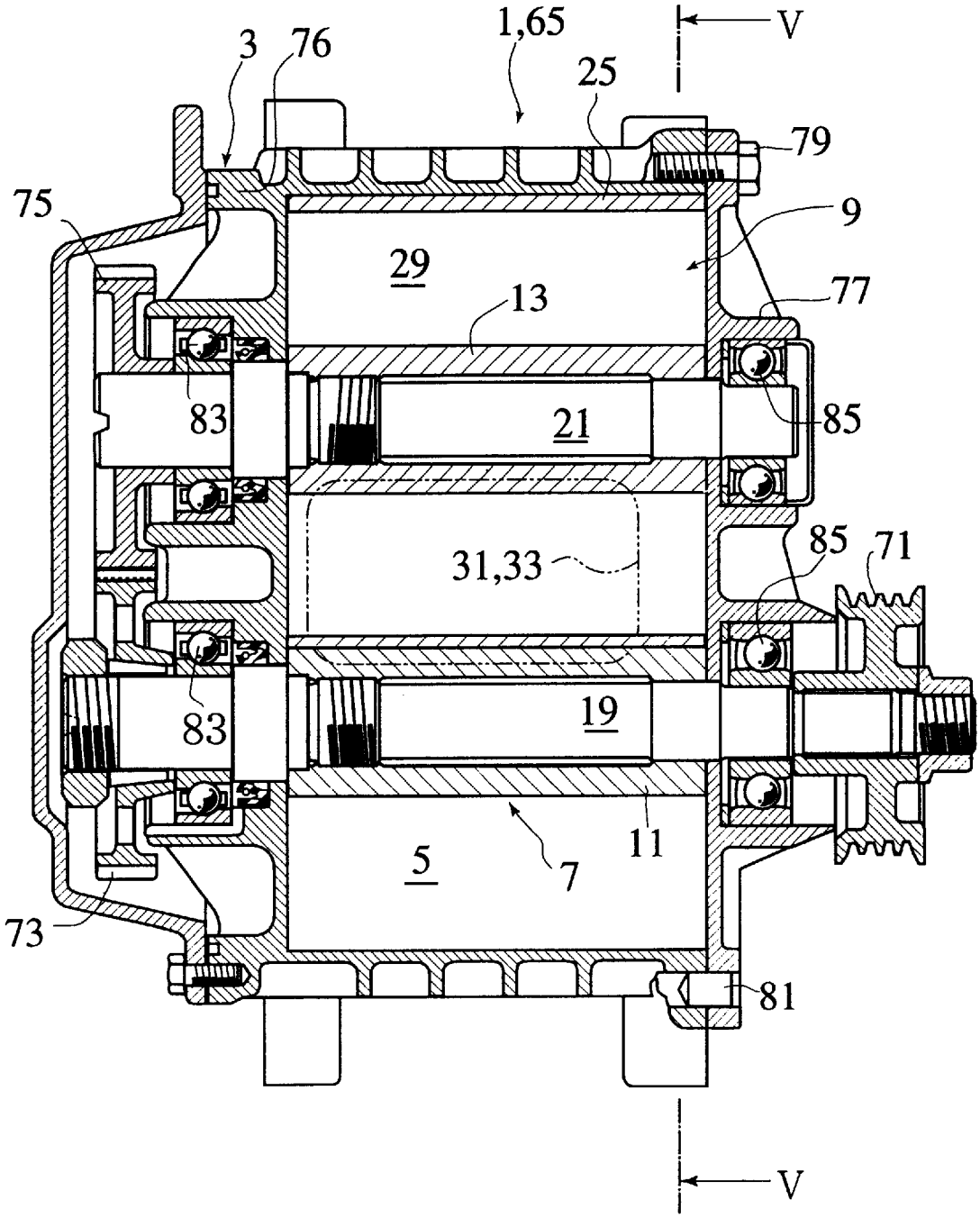
FIG. 4 is a cross section of a front view in accordance with a first and a second embodiments according to the present invention.

There will be detailed below the preferred embodiments of the present invention with reference to the accompanying drawings. Like members are designated by like reference characters.

Figure 5:
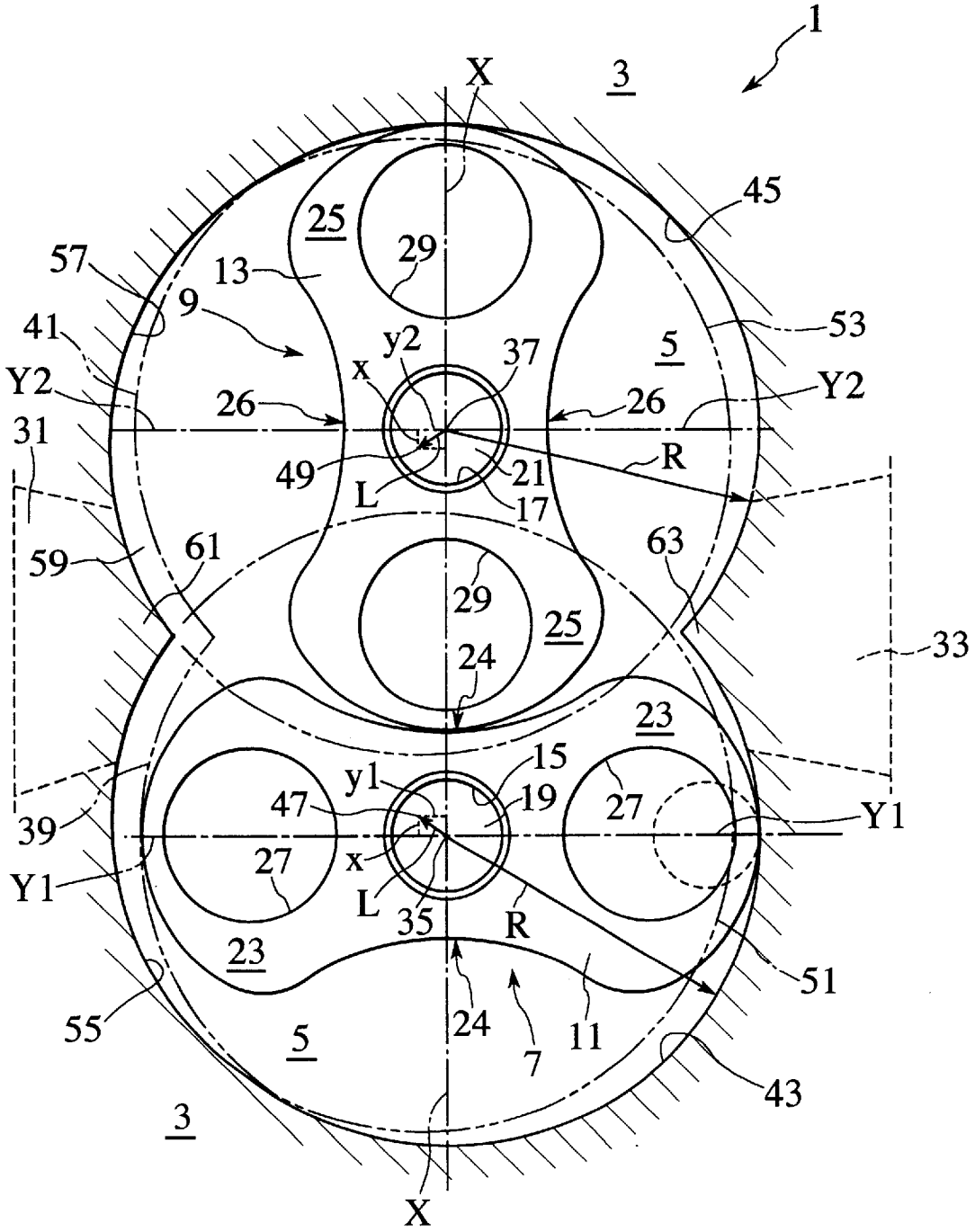
FIG. 5 is a cross sectional view taken along the lines V—V in FIG. 4 which shows the first embodiment in accordance with the present invention.

A first embodiment in accordance with the present invention will described below with respect to FIG. 5. This embodiment is provided with the features stated in the first, second third and fourth aspects. FIG. 5 shows a Roots displacement compressor 1 as a fluid machine in accordance with the embodiment, and the compressor 1 is used for a supercharger of an automotive vehicle.

The supercharger is constituted by an input pulley 71, a timing gear set 73 and 75, a Roots displacement compressor 1 and the like.

As shown in FIG. 5, the compressor 1 is provided with a compressor casing 3 and a pair of rotors 7 and 9 disposed within a rotor chamber 5 provided in the casing 3.

The rotors 7 and 9 are respectively constituted by rotor bodies 11 and 13, rotor shafts 19 and 21 fixed to axial holes 15 and 17 thereof, and the like. In the respective rotor bodies 11 and 13, two convex portions 23 and 25 formed in such a manner as to extend to an axial direction are rotated to the reverse direction while being meshed with opposite concave portions 26 and 24.

The rotor bodies 11 and 13 of the rotors 7 and 9 are rotated and meshed with each other to keep a clearance between the rotor bodies 11 and 13 during the rotors 7 and 9 are driven and rotated through the timing gear set 73 and 75. Therefore, the rotor bodies 11 and 13 are rotated and meshed with each other without contact, to keep the clearance. In other wards, respective connections between the rotor body 11 of the rotor 7 and the timing gear 73 and between the rotor body 13 of the rotor 9 and the timing gear 75 are designed so that the rotor bodies 11 and 13 are rotated and meshed with each other without contact when the timing gear set 73 and 75 are contactingly meshed with each other.

The respective rotors 7 and 9 reduce an inertia moment by providing hollow portions 27 and 29 each having a circular cross section in the respective convex portions 23 and 25, thereby improving a response of the supercharger at a time of an acceleration and the like.

A suction port 31 as a flow inlet port and a discharge port 33 as a flow outlet port are provided at a position substantially perpendicular to an axial direction of the rotor shafts 19 and 21 in the casing 3. A taper is attached to the suction port 31 and the discharge port 33 in such a manner that a flow passage area becomes wide toward the outer side as shown in FIG. 5.

The input pulley 71 is connected to the input end rotor shaft 19 by a spline, and is connected to a crank shaft end pulley through a belt. An electromagnetic clutch is assembled to the crank shaft end pulley, so that the input pulley 71 is rotated through the electromagnetic clutch by a drive force of an engine.

A timing gear set 73 and 75 are constituted by a pair of timing gears meshed with each other, and the timing gears 73 and 75 are respectively connected to the rotor shaft 19 and 21.

The compressor 1 is rotated by the drive force of the engine input from the input pulley 71. At this time, the timing gear set 73 and 75 synchronously rotate the rotors 7 and 9 to the reverse direction in such a manner that the rotors 7 and 9 are not brought into contact with each other. The driven compressor 1 sucks an intake air from the suction port 31 by a rotation of the rotors 7 and 9 and discharges the air from the discharge port 33 so as to supercharge the engine.

The casing 3 is structured such that a cover 77 is fixed to an opening portion disposed on a side in an axial direction of a casing body 76 by bolts 79 and locate pins 81, and the rotor chamber 5 is provided between the casing body and the cover. Furthermore, the rotor shafts 19 and 21 are rotatably mounted to the casing body 76 and the cover 77 through bearing members 83 and 85, respectively.

The rotor chamber 5 is formed by combining a pair of cylindrical portions 43 and 45 (having a radius R) which respectively have rotating centers 35 and 37 in a standard position of the rotors 7 and 9 and correspond to rotating tracks 39 and 41 of the convex portions 23 and 25 and a pair of cylindrical portions 55 and 57 (having a radius R) which respectively have moved rotating centers 47 and 49 a predetermined distance L moved from the standard rotating centers 35 and 37 and correspond to rotating tracks 51 and 53 of the convex portions 23 and 25.

Further, when a line connecting between the standard rotating centers 35 and 37 is set to be X and lines perpendicular to the line X and passing through the respective standard rotating centers 35 and 37 are set to be Y1 and Y2, the suction port 31 and the discharge port 33 are disposed inside these two lines Y1 and Y2 and the moved rotating center 47 and 49 are moved to the suction port 31 from the standard rotating centers 35 and 37 as a beginning point.

The process or machining of the rotor chamber 5 is performed in such a manner as to drill each of the cylindrical portions 43 and 45 of the casing body in correspondence to the standard rotating centers 35 and 37 at first, and further to process each of the cylindrical portions 55 and 57 while moving the drill (or a formed end mill cutter instead of the drill) to the suction port 31 end at a predetermined distance L from each of the cylindrical portions 43 and 45 as in a manner mentioned above.

The rotor chamber 5 is expanded at a volume shown by an arrow 59 by processing the cylindrical portions 55 and 57 so as to expand in the above manner.

Further, a convex portion 61 is formed by crossing each of the cylindrical portions 55 and 57 in the suction port 31 end and a convex portion 63 is formed by crossing each of the cylindrical portions 43 and 45 in the discharge port 33 end.

Still further, when the respective components in the line X direction, the line Y1 direction and the line Y2 direction of the predetermined distance L is set to be x, y1 and y2, these are selected among the range of 0.05 (mm)$\leqq$x, y1, y2$\leqq$0.3 (mm), and in this embodiment, x, y1 and y2 are respectively set to be 0.1 mm.

In the above manner, the supercharger in accordance with the first embodiment is structured.

In the supercharger, as mentioned above, in the rotor chamber 5 of the compressor 1, the rotor chamber 5 is expanded by moving the standard rotating centers 35 and 37 of the cylindrical portions 43 and 45 to the moved rotating centers 47 and 49 at the distance L toward the suction port 31 end so as to process the cylindrical portions 55 and 57.

In the compressor 1, the discharge port 33 end becomes in a high temperature and the suction port 31 end becomes in a low temperature, however, even when the suction port 31 is displaced to the inner side by the expansion and the compression due to the temperature difference therebetween, or even when each of the rotors 7 and 9 is displaced to the suction port 31 end by the pressure difference between the suction port 31 and the discharge port 33, the distortion of the casing and the displacement of each of the rotors 7 and 9 are absorbed by expanding the rotor chamber 5 to the cylindrical portions 55 and 57 from the cylindrical portions 43 and 45.

Accordingly, the interference between the casing 3 and each of the rotors 7 and 9 can be prevented, so that the abrasion and the seizure of these elements, the poor motion of the compressor 1 and the like can be prevented.

In addition to this, the range of each of the components x, y1 and y2 given by the relation 0.05 (mm)$\leqq$x, y1, y2$\leqq$0.3 (mm) shows an optimum range of the distance L, and since the value of each of the components x, y1 and y2 is selected to 0.1 mm within this range as mentioned above, the interference between the casing 3 and each of the rotors 7 and 9 are prevented while maintaining a performance of the compressor 1 a normal condition.

Further, since the taper is given to the discharge port 33 so as to make the flow passage area wide toward the outer side, the flow speed change of the discharged intake air is reduced and the sound is reduced.

Figure 6:
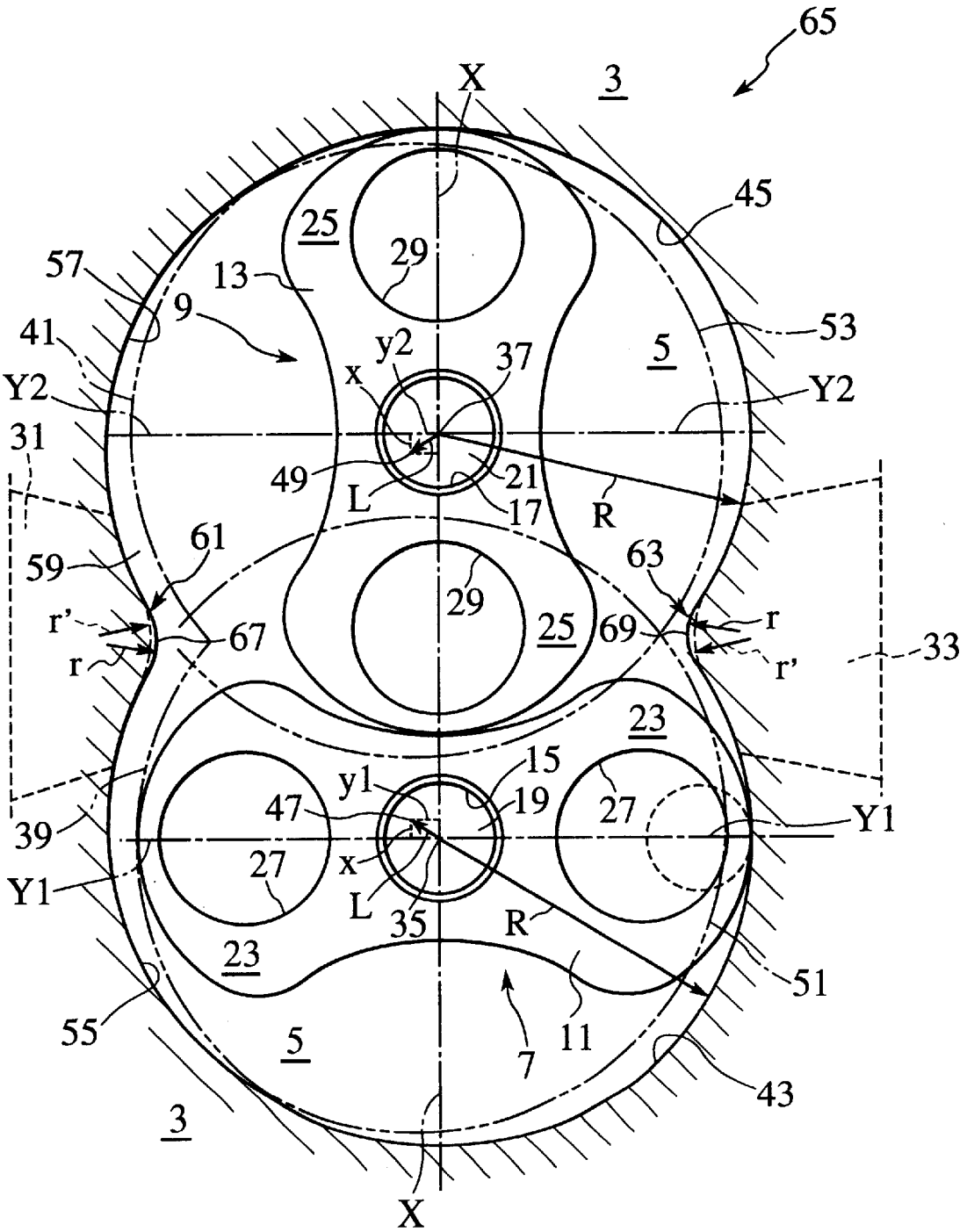
FIG. 6 is a cross sectional view which shows the second embodiment in accordance with the present invention by modifying a portion of the rotor chamber shown in FIG. 5.

Next, a second embodiment in accordance with the present invention will be described below with reference to FIG. 6. The embodiment is provided with the features stated in the fifth aspect to the eighth aspect. FIG. 6 shows a Roots displacement compressor 65 as a fluid machine in accordance with the embodiment, and the compressor 65 is used for a supercharger of a vehicle.

As in the same manner as that of the compressor 1 in accordance with the first embodiment, the convex portion 61 is formed in the suction port 31 end of the casing 3 by crossing each of the cylindrical portions 55 and 57 to each other, and the convex portion 63 is formed in the discharge port 33 end by crossing each of the cylindrical portions 43 and 45 to each other.

In the case of the compressor 65, as shown in FIG. 6, round portions 67 and 69 having a predetermined radius r are given to these convex portions 61 and 63.

The predetermined radius "r" N is selected among a range of $\frac{1}{10}$R (mm)$\leqq$r$\leqq\frac{1}{5}$R (mm) when the radius of the circles 43 and 45 corresponding to the rotating tracks 39 and 41 of the respective rotors 7 and 9 is set to be R.

Further, the radius r is adjusted in accordance with the deformation amount of the casing 3 different along the axial direction of each of the rotors 7 and 9 and the displacement amount of each of the rotors 7 and 9, and an optimum radius r is given in all the range of the convex portions 61 and 63 along the axial direction of the rotors 7 and 9.

More specifically, the radius r around the bearing members 83 and 85 which are located in both end portions of the rotors 7 and 9 is increasing to become a radius r' in accordance with progressing toward around the suction port 31 and the discharge port 33 which are located in approximately middle portion of the rotor chamber 5 in the longitudinal direction thereof. The radius r' located in the approximately middle portion of the rotor chamber 5 which is shown as dotted lines in FIG. 6, is larger than the radius r around the bearing members 83 and 85.

The supercharger in accordance with the second embodiment is constituted in the above manner.

In the compressor 65 of the supercharger, as in the same manner as that of the compressor 1 mentioned above, since the cylindrical portions 55 and 57 are processed by moving the cylindrical portions 43 and 45 to the suction port 31 end at a degree of the distance L, the suction port 31 is displaced to the inner side due to the temperature difference, and even when each of the rotors 7 and 9 is displaced to the suction port 31 end due to the pressure difference, the interference between the casing 3 and each of the rotors 7 and 9 is prevented, so that the abrasion and the seizure between these elements, the poor motion in the compressor 65 and the like can be prevented.

In addition to this, in the compressor 65, since the round portions 67 and 69 having a predetermined radius r are given to the convex portions 61 and 63 formed in both sides of the suction port 31 end and the discharge port 33 end, even when the casing 3 and each of the rotors 7 and 9 are interfered with each other by the displacement in the convex portion 61 close to the suction port 31 due to the temperature difference and the displacement of each of the rotors 7 and 9 due to the pressure difference, the abrasion and the seizure between each of the rotors 6 and 7 and the casing 3 can be prevented by the round portion 67 given to the convex portion 61, and the poor motion in the compressor 65 can be prevented.

Further, the range of the radius r of the round portion given by the relation $\frac{1}{10}R$ (mm)$\leqq r \leqq \frac{1}{5}R$ (mm) shows an optimum range of the radius r, and since the value of the radius r is selected among the range, the performance of the compressor 65 can be maintained in a normal condition while the abrasion, the seizure and the poor motion when the casing 3 and each of the rotors 7 and 9 are interfered with each other.

Still further, since the deformation amount of the casing 3 is different along the axial direction of each of the rotors 7 and 9 and the displacement of each of the rotors 7 and 9 is generated in such a manner that each of the rotors 7 and 9 swings around the bearing, thereby being different along the axial direction of each of the rotors 7 and 9. Accordingly, as mentioned above, the radius r is adjusted in all the area of the convex portions 61 and 63 along the axial direction of the rotors 7 and 9 and the optimum radius r is given in each portion, so that the abrasion and the seizure between the convex portions 61 and 63 and each of the rotors 7 and 9, the poor motion in the compressor 65 and the like can be effectively prevented.

Furthermore, the gap is formed between the casing 3 and each of the rotors 7 and 9 by the round portion 69 given in the convex portion 63 close to the discharge port 33, the flow speed change of the discharged intake air can be reduced by the gap and the sound can be widely reduced.

Moreover, by making the flow passage area of the discharge port 33 wide toward the outer side, the flow speed change of the discharge intake air can be reduced and the sound can be reduced.

The structure in which the sound is widely reduced in the above manner is particularly advantageous for the Roots displacement fluid machine having a great sound in the discharge end such as the compressor 65.

Further, the gap is formed between the casing 3 and each of the rotors 7 and 9 by the round portion 67 given in the convex portion 61 near the suction port 31 and the interference between the casing 3 and each of the rotors 7 and 9 can be prevented by the gap, so that the abrasion and the seizure between the casing 3 and each of the rotors 7 and 9, the poor motion in the compressor 65 and the like can be prevented in the same manner as that of the first embodiment.

In this case, the fluid machine in accordance with the present invention can be used for a hydraulic motor which takes out a rotation force by a fluid pressure in addition to the compressor in the embodiments which moves the fluid by the rotation of the rotor.

While preferred embodiments of the present invention have been described using specific terms, such description is for illustrative purposes, and it is to be understood that changes and variations may be made without departing from the spirit or scope of the following claims.

What is claimed is:

1. A fluid machine, comprising:

a pair of rotors formed with a concave portion and a convex portion in such a manner as to extend to an axial direction, the pair of rotors meshed with each other at the concave portion and the convex portion; and a casing having a rotor chamber formed with a first pair of cylindrical portions enveloping each of the rotors, the casing having a flow inlet port and a flow outlet port for a fluid formed in the casing at a position substantially perpendicular to the axial direction of each of the rotors, the flow inlet port and the flow outlet port disposed inside two lines Y1 and Y2 which are perpendicular to a line X connecting centers of both of the cylindrical portions and pass through the center of each of the cylindrical portions, wherein, the rotor chamber is formed with a second pair of cylindrical portions including a horizontal cross sectional shape which is constituted by a part of a circle corresponding to a second rotation track of each of the rotors, together with the first pair of cylindrical portions including a horizontal cross sectional shape which is constituted by a part of a circle corresponding to a first rotation track of each of the rotors, and wherein the second pair of cylindrical portions are moved toward a lower pressure end among the flow inlet port and the flow outlet port from a position of the first pair of cylindrical portions at a predetermined distance L, thereby the volume of the rotor chamber is expanded, and a first component (x) of the predetermined distance in a direction of the vertical line (X) is set to he "x", a relation 0.05 (mm)$\leqq x \leqq$0.3 (mm) is made and a second component (y1, y2) of the predetermined distance in a direction perpendicular to the vertical line (X) is set to be "y1" or "y2", a relation 0.05 (mm)$\leqq$y1, y2$\leqq$0.3 (mm) is made.

2. The fluid machine according to claim 1, wherein each of the rotors is rotated by a prime mover and the fluid is sucked from the flow inlet port of the casing and is discharged from the flow outlet port.

3. A pair of rotors formed with a concave portion and a convex portion in such a manner as to extend to an axial direction, the pair of rotors meshed with each other at the concave portion and the convex portion; and a casing having a rotor chamber formed with a first pair of cylindrical portions enveloping each of the rotors, the casing having a flow inlet port and a flow outlet port for a fluid formed in the casing at a position substantially perpendicular to the axial direction of each of the rotors, the flow inlet port and the flow outlet port disposed inside two lines Y1 and Y2 which are perpendicular to a line X connecting centers of both of the cylindrical portions and pass through the center of each of the cylindrical portions, wherein, the rotor chamber is formed with a second pair of cylindrical portions including a horizontal cross sectional shape which is constituted by a part of a circle corresponding to a second rotation track of each of the rotors, together with the first pair of cylindrical portions including a horizontal cross sectional shape which is constituted by a part of a circle corresponding to a first rotation track of each of the rotors, and wherein the second pair of cylindrical portions are moved toward a lower pressure end among the flow inlet port and the flow outlet port from a position of the first pair of cylindrical portions at a predetermined distance L, thereby the volume of the rotor chamber is expanded, and wherein each of the cylindrical portions are crossed to each other so as to form a round portion having a predetermined radius r on one or both of a convex portion formed in the flow inlet port end and the flow outlet port end, and wherein when a radius of a circle corresponding to a rotating track of each of the rotors is set to be R, and the predetermined radius of the convex formed on the cross point between the first upper and lower cylindrical portions is set to be r, a relation $\frac{1}{10}R\ (mm) \leqq r \leqq \frac{1}{5}R\ (mm)$ is made.

4. The fluid machine according to claim 5, wherein each of the rotors is rotated by a prime mover and a fluid is sucked from a flow inlet port of the casing and is discharged from the flow outlet port.

5. A pair of rotors formed with a concave portion and a convex portion in such a manner as to extend to an axial direction, the pair of rotors meshed with each other at the concave portion and the convex portion; and a casing having a rotor chamber formed with a first pair of cylindrical portions enveloping each of the rotors, the casing having a flow inlet port and a flow outlet port for a fluid formed in the casing at a position substantially perpendicular to the axial direction of each of the rotors, the flow inlet port and the flow outlet port disposed inside two lines Y1 and Y2 which are perpendicular to a line X connecting centers of both of the cylindrical portions and pass through the center of each of the cylindrical portions, wherein, the rotor chamber is formed with a second pair of cylindrical portions including a horizontal cross sectional shape which is constituted by a part of a circle corresponding to a second rotation track of each of the rotors, together with the first pair of cylindrical portions including a horizontal cross sectional shape which is constituted by a part of a circle corresponding to a first rotation track of each of the rotors, and wherein the second pair of cylindrical portions are moved toward a lower pressure end among the flow inlet port and the flow outlet port from a position of the first pair of cylindrical portions at a predetermined distance L, thereby the volume of the rotor chamber is expanded, and wherein each of the cylindrical portions are crossed to each other so as to form a round portion having a predetermined radius r on one or both of a convex portion formed in the flow inlet port end and the flow outlet port end, and wherein the predetermined radius r is set to be a different value along an axial direction of each of the rotors.

6. The fluid machine according to claim 3, wherein each of the rotors is rotated by a prime mover and a fluid is sucked from a flow inlet port of the casing and is discharged from the flow outlet port.

* * * * *